US006405456B1

(12) United States Patent
Nichelson

(10) Patent No.: US 6,405,456 B1
(45) Date of Patent: Jun. 18, 2002

(54) SHOCK REDUCING INNERSOLE

(76) Inventor: Gregg R. Nichelson, 804 Cross Bend Rd., Plano, TX (US) 75023

( * ) Notice: Subject to any disclaimer, the term of this patent is extended or adjusted under 35 U.S.C. 154(b) by 0 days.

(21) Appl. No.: 09/829,850

(22) Filed: Apr. 10, 2001

Related U.S. Application Data

(60) Provisional application No. 60/196,148, filed on Apr. 11, 2000.

(51) Int. Cl.[7] ..... A43B 13/20

(52) U.S. Cl. ..... 36/29; 36/27; 36/28; 36/35 B; 36/35 R; 36/30 R; 36/38

(58) Field of Search ..... 36/29, 27, 28, 36/30 R, 35 R, 35 B, 38

(56) References Cited

U.S. PATENT DOCUMENTS 2,444,865 A * 7/1948 Warrington ..... 36/36 R
4,067,125 A * 1/1978 Greene, Sr. ..... 12/146 R
4,844,194 A * 7/1989 De Alessi et al. ..... 104/23.2
5,502,901 A * 4/1996 Brown ..... 36/27
5,743,028 A * 4/1998 Lombardino ..... 36/27
6,234,987 B1 * 5/2001 Chen ..... 36/141
6,314,661 B1 * 11/2001 Chern ..... 36/11.5

* cited by examiner

*Primary Examiner*—Ted Kavanaugh
(74) *Attorney, Agent, or Firm*—George L Williamson

(57) ABSTRACT

An innersole device for reducing shock to the feet of the user of shoes as would occur with one who is running in his shoes. A shoe sole and innersole is disclosed having several types of shock reduction methods including: (1) opposing magnets with compressed air/nitrogen bubbles inserted therebetween; (2) inner shock absorbers in the lower sole/heel of the shoe; (3) multiple, e.g., four shock absorbers, attached to the lower sole and the heel cup; (4) a flexible middle sole having a flexible cavity therein containing water or gel.

14 Claims, 1 Drawing Sheet

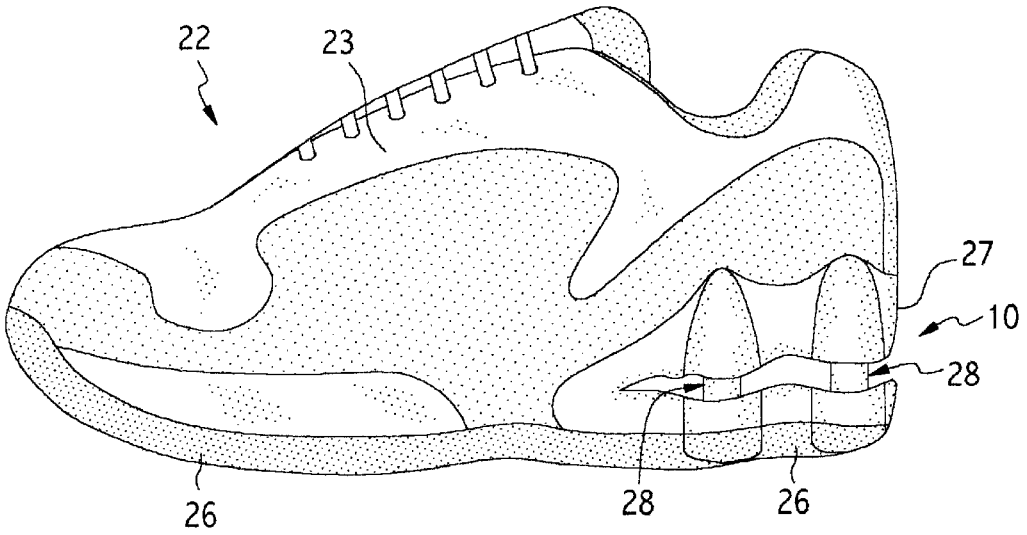
FIG. 2
FIG. 4
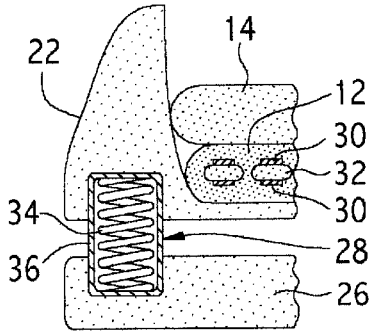
FIG. 1
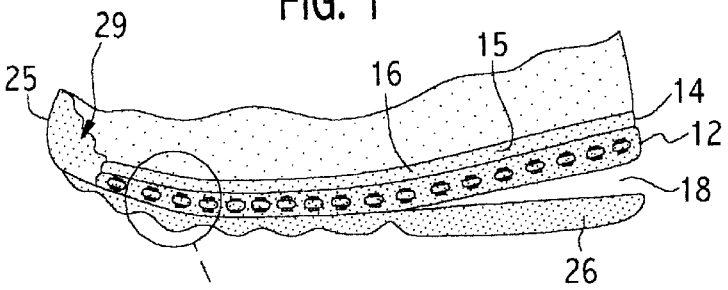
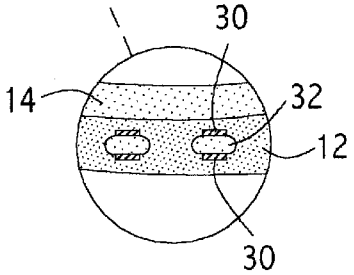
FIG. 3
FIG. 5
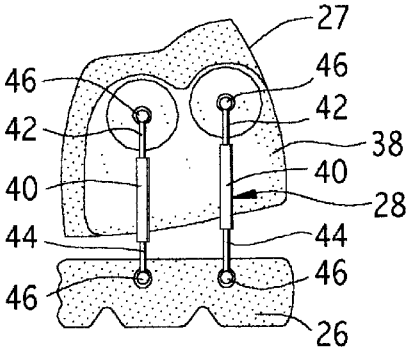

SHOCK REDUCING INNERSOLE

This application claims benefit of U.S. Provisional Application Ser. No. 60/196,148 filed on Apr. 11, 2000.

BACKGROUND OF THE INVENTION

1. Field of the Invention

The present invention relates generally to shoes and, more particularly, is concerned with the soles and innersoles of shoes for reducing shock to the user and would especially be applicable to tennis shoes or the like.

2. Description of the Prior Art

Shock reducing innersoles have been described in the prior art. However, none of the prior art devices disclose the unique features of the present invention.

In U.S. Pat. No. 5,502,901, dated Apr. 2, 1996, Brown disclosed an article of footwear which has an outsole with a cavity in the heel region in which a cushioning insert is installed to cushion impacts and provide added lift to the wearer. The heel region of the outsole projects outwardly beyond the periphery of the heel region of the shoe upper to form a projecting peripheral rim. The cavity has an upper wall and a lower wall and a plurality of springs extend between the upper and lower walls at spaced intervals around the peripheral rim. Opposing magnets are mounted in the upper and lower walls in a central region of the cavity with their like poles facing one another to provide a magnetic biasing force which augments the spring load.

In U.S. Pat. No. 4,844,194, dated Jul. 4, 1989, De Alessi, et al., disclosed a shoe which has a flat surface which can slide with reduced friction on a guide surface, means for introduction and distribution of compressed air to generate a supporting air cushion between the said surfaces, and a plurality of permanent magnets generating a force of attraction between the shoe and the guide surface in such a way as to cause the shoe itself to stop immediately when the supply of compressed air is interrupted.

In U.S. Pat. No. 5,830,553, dated Nov. 3, 1998, Huang disclosed a shock-absorbing cushion comprising two sheets peripherally sealed and a plurality of half-through holes and/or grooves whose circumferential walls constitute a cubic supporting structure shock-absorbing cushion has a hollow interior possible to be filled with air, gas, liquid or semi solid to change its inner pressure, and is able to be combined with one another to be applied to sports goods, shoe soles, etc., for protecting something from pressure or shock.

In U.S. Pat. No. 5,797,198, dated Aug. 25, 1998, Pomerantz disclosed an adjustable shock absorbing device for a shoe having a horizontal stiff bracket fixed to the midsole of the shoe, a heel plate pivotally mounted at a forward end to the bracket and disposed in the heel portion of the shoe below the wearer's heel, a spring biasing the rearward end of the heel plate vertically relative to the bracket, and an adjustment device for varying the tension of the biasing spring to accommodate changes desired by the wearer.

In U.S. Pat. No. 5,787,609, dated Aug. 4, 1998, Wu disclosed a footwear shock-absorbing device which comprises a main body, at least one shock-absorbing body having a plurality of cavities, and a pliable base equal in number to the shock-absorbing body for sealing off the bottom openings of the cavities such that the pliable base and the cavities form jointly a plurality of the closed air cells capable of alleviating the shock.

In U.S. Pat. No. 5,743,028, dated Apr. 28, 1998, Lombardino disclosed a shoe heel insert, especially suitable for athletic shoe applications, providing for superior shock absorption and energy return characteristics to the wearer, as well as a high degree of stability. The unit which is referred to as the Spring-Air System, will consist of a substantially heel shaped outer spring mechanism which also serves as the internal spring housing by way of a plurality of internally formed projections, and a plurality of vertically affixed compression springs retained by the said projections with the springs biasing the outer spring mechanism. The entire unit will be filled with a pressurized gas and hermetically sealed with a clear, durable polyurethane material, which completely encapsulates the device while still allowing the inner springs to be visible. The assembled unit will be molded within the heel section of the mid-sole of an athletic shoe, or any suitable type shoe, during the shoe's manufacturing process. The internal spring members will be disposed directly below the calcareous of the wearer and the transparent nature of the devices encapsulation will allow the rear part of the shoe's sole to be molded in such a way that the system can be partially exposed, adding further novelty to the shoe.

In U.S. Pat. No. 5,784,808, dated Jul. 28, 1998, Hockerson disclosed an athletic shoe comprising an upper mounted on a sole which is formed with a longitudinal channel that separates the sole into a pair of laterally adjacent compression elements which can move independent of each other. A rigid heel counter is provided in the upper above the heel portion. As the shoe pronates from the heel strike phase to the loading phase the compression element on the lateral side compresses to begin absorbing shock and moves independent of the medial compression element. At the same time the heel counter supports the foot so that the foot undergoes a more natural movement throughout the heel strike, loading and pronation phases.

In U.S. Pat. No. 5,435,079, dated Jul. 25, 1995, Gallegos disclosed an athletic shoe which includes a spring interposed in its sole providing superior shock absorbency and energy return. The coil spring increases in diameter and is fixed between two spacers, wherein the spacer adjacent the largest diameter end of the spring delimits a space therein. During compression, the smaller end of the spring passes through the larger end and into the space defined by the spacer. The structure maximizes energy return and prevents bottoming out during compression. In an alternate construction, the sole having the spring is removable from the shoe portion such that the shoe portion can be fixed to a plurality of soles. The arrangement can be further revised to accommodate a hoofed foot of an animal. The spring can also be concealed in a hollow heel member of a dress shoe.

In U.S. Pat. No. 5,138,776, dated Aug. 18, 1992, Levin disclosed a sports shoe according to the invention which has a highly elastic heel which reduces the shock on the foot during running and jogging. The heel which is made of a resilient, elastic material is in the shape of a strip which is arched in downward direction and connected to the sole at its front end while forming a longitudinal cavity with the sole which is open towards the rear end of the shoe. A spring composed of two leaves which are connected at one end and unconnected at the other end of the spring, are inserted into the cavity with the connected ends positioned at the front end of the cavity and with the unconnected ends close to the rear end of the heel, whereby the upper of the two leaves is connected to the sole and the lower, strongly bent leaf to the arched heel strip. The rear end of the lower leaf is free to slide or to roll along the rear portion of the upper leaf in accordance with the pressure applied to the heel surface during jogging or running, thereby largely increasing the range of compression and decompression of the heel strip resulting in more comfort of the wearer.

In U.S. Pat. No. 4,918,838, dated Apr. 24, 1990, Chang disclosed a sole with compressible shock absorbers which not only provides an improved shock absorbing function but also provides more comfort for the wearer. The shock absorbers consist of a polygonal replaceable air bellows placed in a polygonal recess on the forefoot section of the shoe and a cylindrical replaceable air cylinder placed in a circular recess on the heel section of the shoe. The air cylinder and air bellows are made of an integrally resilient air-tight material such that, during exercise, the shock absorbers absorb and then return the energy in a controlled upward direction, by way of the bellows-type body and the friction caused between the inside wall of the recess and the bellows itself. Moreover, since the shock absorbers can be placed easily by hand, the wearer can adjust the shoes in line with his weight and type of sport performed. The uses of the shoe are therefore maximized because the air cylinder and air bellows will continue to function even after the outer sole has experienced considerable wear and tear.

While these shoe innersole devices may be suitable for the purposes for which they were designed, they would not be as suitable for the purposes of the present invention, as hereinafter described.

SUMMARY OF THE INVENTION

The present invention discloses an innersole device for reducing shock to the feet of the user of shoes as would occur with one who is running in his shoes. A shoe sole and innersole is disclosed having several types of shock reduction methods including: (1) opposing magnets with compressed air/nitrogen bubbles inserted therebetween; (2) inner shock absorbers in the lower sole/heel of the shoe; (3) multiple, e.g., four shock absorbers, attached to the lower sole and the heel cup; (4) a flexible middle sole having a flexible cavity therein containing water or gel.

An object of the present invention is to provide greater comfort to the user of the shoes. A further object of the invention is to improve the support to the user's feet by his shoes. Another object is to reduce shock to the legs and feet of a runner and/or to reduce injuries such as heel spurs to the runner.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example with reference to the accompanying drawings in which:

FIG. 1 is a cross-section view taken through the center of the shoe of the present invention.

FIG. 2 is a perspective view of parts of the present invention.

FIG. 3 is an enlarged cross-sectional view of the sole of the present invention taken from FIG. 1 as indicated.

FIG. 4 is a cross-section view of the heel area of the present invention.

FIG. 5 is a perspective view of parts of the present invention.

LIST OF REFERENCE NUMERALS

With regard to reference numerals used, the following numbering is used throughout the drawings.

10 present invention
12 middle sole
14 inner sole
15 cavity
16 water
18 air space
22 shoe
23 leather upper portion
25 toe
26 lower sole
27 heel area
28 shock absorber
29 space
30 magnets
32 air/nitrogen
34 coil spring
36 cover
38 heel cup
40 chamber
42 shock absorber rod
44 shock absorber rod
46 attachment means

DESCRIPTION OF THE PREFERRED EMBODIMENT(S)

Turning now descriptively to the drawings, in which similar reference characters denote similar elements throughout the several views, FIGS. 1 through 5 illustrate the present invention being an innersole device for reducing shock to the feet of the user of the shoes.

Turning to FIG. 1, shown therein is a cross-section view of the shoe sole of the present invention. Shown therein is the lower sole 26, the middle sole 12 and the upper, inner sole 14 of the present invention 10. Shown therein is an inner sole 14 forming a fully-enclosed cavity 15 made of plastic and having a liquid or gel such as water or gel 16 contained therein as a shock absorbent. Also shown is the shoe toe 25 having an enlarged space 29 therein wherein the toes of the user are free to move about. Air space 18 is provided between middle sole 12 and lower sole 26 to allow room for shock absorber installation which will be described hereinafter.

Turning to FIG. 2, therein is shown a shoe 22 containing the present invention 10. Shown is a shoe 22 having a leather or the like upper portion 23 to which the elements of the present invention are attached. Also shown is a lower sole 26 which has positioned vertically therein in the heel area 27, a plurality of shock absorbers 28 which have the purpose of reducing the shock to the heel area 27 of the user of the present invention 10. Lower sole 26 is disposed in direct contact with the ground or other walking surface. Shoe 22 is a tennis shoe being otherwise of conventional design. Shoe 22 could also be an industrial, hiking, dress shoe or the like.

Turning to FIG. 3, therein is shown an enlarged cross sectional view taken from FIG. 1 as indicated of a sole 12, 14 of the present invention showing multiple upper and lower magnets 30 separated by, e.g., a mixture of air and compressed nitrogen 32 which can be a 50% water mixture contained in each bubble of the air and compressed nitrogen 32. The purpose of the air bubble is to separate the magnets from each other and provide a cushion therein between magnets 30. Magnets 30 must be inserted so that like poles repel, i.e., North Pole faces toward North Pole and/or South Pole faces toward South Pole and thereby create a repulsive force in the bubble.

Turning to FIG. 4, therein is shown a cross-section view of the heel area 27 of the present invention showing a shock absorber 28 positioned therein. The purpose of the shock absorbers 28 is to reduce shock to the user of the shoes 22. The shocks 28 are mounted so that their longitudinal axis is generally vertically standing. The shock absorbers 28 have an inner coil spring 34 contained within an outer wrapper or cover 36 which prevents contamination by dirt or grit. The shock absorber may be molded directly into the body of the shoes 22. Also shown are the inner sole 14, middle sole 12, lower sole 26, magnets 30 and bubble 32.

Turning to FIG. 5, shown therein is a perspective view of an alternative embodiment of the shock absorber 28. Shown is the lower sole 26 and the heel area 27 of the shoe having a metal heel cup 38 disposed thereon. In this embodiment, the shock absorbers are small metal pneumatic shock absorbers or the like having a pneumatic chamber 40 and a pair of rods 42, 44 which slide internal the chamber 40 in the conventional manner. The rods 42, 44 have attachment means 46 to the heel cup 38 and lower sole 26. This embodiment might, e.g., be used on industrial boots.

Concerning construction of the present invention, the soles could be made of polyurethane, the magnets could be permanent magnets and use stainless steel supports.

Other embodiments of the present invention could be described which could use electromagnets connected to a small battery with appropriate electrical connecting means having the magnets located in the soles of the shoes between the heel and toe of the shoes.

What is claimed to be new and desired to be protected by Letters Patent is set forth in the appended claims:

I claim:

1. An apparatus for a shoe sole and inner sole, comprising:

a) a first upper inner sole, said inner sole having a cavity therein;

b) a shock absorbing material disposed internal said cavity of said inner sole;

c) a second lower sole disposed on the bottom of the shoe;

d) a third middle sole disposed between said inner sole and said lower sole;

e) a plurality of bubbles disposed in an array throughout said middle sole; and, f) a first magnet disposed on the top of each said bubble and a second magnet disposed on the bottom of each said bubble, said magnets oriented so that the magnetic fields of said magnets repel each other.

2. The apparatus of claim 1, further comprising said inner sole and said middle sole terminated short of the toe of the shoe having a space formed thereby to receive the toes of a user.

3. The apparatus of claim 2, wherein said shock absorbing material further comprises gel for absorbing shock.

4. The apparatus of claim 3, wherein said shock absorbing material further comprises water for absorbing shock.

5. The apparatus of claim 4, wherein said middle sole and said lower sole have an air space thereinbetween for receiving means for a shock absorber, said air space disposed in the heel area of the shoe.

6. The apparatus of claim 5, further comprising means for a shock absorber disposed internal said air space.

7. The apparatus of claim 6, wherein said means for a shock absorber further comprises a plurality of shock absorbers disposed in the heel area of the shoe.

8. The apparatus of claim 7, wherein said shock absorbers further comprise a coil spring disposed in said shock absorber.

9. The apparatus of claim 8, further comprising a cover disposed on the outside of said coil spring to prevent contamination from dirt and debris.

10. The apparatus of claim 9, wherein a first end of said shock absorber is disposed in said lower sole of the shoe and a second end of said shock absorber is disposed in said heel area of the shoe.

11. The apparatus of claim 7, further comprising a heel cup disposed on the lower part of said heel of said shoe.

12. The apparatus of claim 11, further comprising a plurality of shock absorbers, said shock absorbers further comprising a pneumatic chamber, further having a first rod connected to a first end of said pneumatic chamber and a second rod connected to a second end of said pneumatic chamber, wherein said first and second rods are slidable internal said pneumatic chamber.

13. The apparatus of claim 12, further comprising said first rod being connected to said heel cup and said second rod being connected to said lower sole.

14. The apparatus of claim 1, wherein said bubbles further comprise air being contained internal said bubbles.

* * * * *